US006748824B2

(12) United States Patent
Chen

(10) Patent No.: US 6,748,824 B2
(45) Date of Patent: Jun. 15, 2004

(54) RATCHET WRENCH HAVING SOCKET ADAPTER SECURING DEVICE

(76) Inventor: Hsin Nien Chen, No. 10, Lane 143, Sec. 1, Hsin Shen South Road, Taipei (TW), 106

( * ) Notice: Subject to any disclaimer, the term of this patent is extended or adjusted under 35 U.S.C. 154(b) by 68 days.

(21) Appl. No.: 10/083,434

(22) Filed: Feb. 27, 2002

(65) Prior Publication Data

US 2003/0136230 A1 Jul. 24, 2003

(30) Foreign Application Priority Data

Jan. 18, 2002 (TW) ..... 91200657 U

(51) Int. Cl.[7] ..... B25B 13/46

(52) U.S. Cl. ..... 81/60; 81/61; 81/177.85

(58) Field of Search ..... 81/58, 58.1, 58.2, 81/58.3, 58.4, 58.5, 59.1, 60, 61, 62, 63, 63.1, 63.2, 177.85

(56) References Cited

U.S. PATENT DOCUMENTS

| | | | | |
|---|---|---|---|---|
| 5,509,331 A | * | 4/1996 | Nickipuck | 81/58.3 |
| 6,006,631 A | | 12/1999 | Miner et al. | 81/177.85 |
| 6,067,881 A | * | 5/2000 | Albertson | 81/59.1 |
| 6,257,096 B1 | * | 7/2001 | Ling | 81/60 |
| 6,260,448 B1 | * | 7/2001 | Chaconas | 81/63 |

* cited by examiner

*Primary Examiner*—Joseph J. Hail, III
*Assistant Examiner*—David B. Thomas
(74) *Attorney, Agent, or Firm*—Charles E. Baxley

(57) ABSTRACT

A ratchet wrench includes a ratchet wheel received in the bore of a head and having a number of teeth, and having an engaging hole for receiving a socket adapter. A pawl may control the ratchet wheel to be driven by the head. The socket adapter includes a shell engaged in the ratchet wheel, and a shank extended from the shell for engaging with a tool member. Two balls are engaged in the shell and the shank. A shaft is slidably engaged in the shell and the shank for selectively actuating the balls to engage with the lower portion of the ratchet wheel and the tool member simultaneously.

7 Claims, 3 Drawing Sheets

RATCHET WRENCH HAVING SOCKET ADAPTER SECURING DEVICE

BACKGROUND OF THE INVENTION

1. Field of the Invention

The present invention relates to a ratchet wrench, and more particularly to a ratchet wrench having a securing device for solidly securing or retaining the socket adapter and/or the ratchet wheel to the handle of the ratchet wrench.

2. Description of the Prior Art

Various kinds of typical ratchet wrenches have been developed and used today. U.S. Pat. No. 6,257,096 to Ling discloses one of the typical ratchet wrenches and comprises a ratchet wheel rotatably received in each end of the handle, and a socket adapter engaged in the ratchet wheel for being driven by the ratchet wheel and for engaging with and for driving the other tool members, such as the sockets. A plastic O-ring is resiliently engaged between the ratchet wheel and the handle for retaining the ratchet wheel to the handle. However, the plastic O-ring will be twisted and damaged by the teeth formed or provided on the outer peripheral portion of the ratchet wheel when the ratchet wheel is rotated and driven by the handle. The handle includes no suitable retaining device for securing the ratchet wheel to the handle.

U.S. Pat. No. 6,006,631 to Miner et al. discloses the other typical adapter to be engaged in the typical ratchet. The typical adapter includes a release actuator received in a shell and having a beveled section for engaging with and for moving one or more balls outward of the shell to engage with and to secure the other tool member to the adapter. The typical ratchet includes a latching pin or a spring-biased projection engaged in the end thereof and for engaging with the adapter, in order to retain the adapter to the end of the handle. However, the end of the handle is normally O or ring-shaped and having a small thickness that have no space for receiving the spring-biased projection. The end of the handle should be drilled with a hole for receiving the spring-biased projection, such that the strength of the end of the handle will be greatly decreased. The handle also includes no suitable retaining device for solidly securing or retaining the ratchet wheel to the handle.

The present invention has arisen to mitigate and/or obviate the afore-described disadvantages of the conventional ratchet wrench.

SUMMARY OF THE INVENTION

The primary objective of the present invention is to provide a ratchet wrench including a securing device for solidly securing or retaining the socket adapter and/or the ratchet wheel to the handle of the ratchet wrench.

In accordance with one aspect of the invention, there is provided airatchet wrench comprising a handle including a head having a bore, a ratchet wheel rotatably received in the bore of the head, the ratchet wheel including an outer peripheral portion having a plurality of teeth, and including an engaging hole and an upper portion and a lower and inner peripheral portion, means for controlling a driving direction of the ratchet wheel by the head of the handle, a socket adapter including a shell engaged in the engaging hole of the ratchet wheel, and a shank extended from the shell for engaging with a tool member, a first ball engaged in the shell, a second ball engaged in the shank, and a shaft slidably engaged in the shell and the shank for selectively actuating the first ball to engage with the lower and inner peripheral portion of the ratchet wheel and to secure the ratchet wheel to the socket adapter, and for selectively actuating the second ball to engage with the tool member and to secure the tool member to the shank.

A third ball is further provided and engaged in the shell and engaged with the first ball, for allowing the first ball and the third ball to be actuated to engage with the lower and inner peripheral portion of the ratchet wheel.

The head of the handle includes an upper portion, the shell includes an enlarged knob provided on top and engaged with the upper portion of the ratchet wheel and engaged with the upper portion of the head.

A device may further be provided for retaining the upper portion of the ratchet wheel to the head.

The engaging hole of the ratchet wheel is a non-circular engaging hole, the shell includes an outer peripheral portion having a non-circular engaging surface for engaging with the non-circular engaging hole of the ratchet wheel and for allowing the shell to be rotated in concert with the ratchet wheel.

A spring-biased projection may further be provided in the shell for engaging with the ratchet wheel and for positioning the ratchet wheel to the shell.

A spring biasing device may further be provided for bias the shaft to actuate the first and the second balls.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
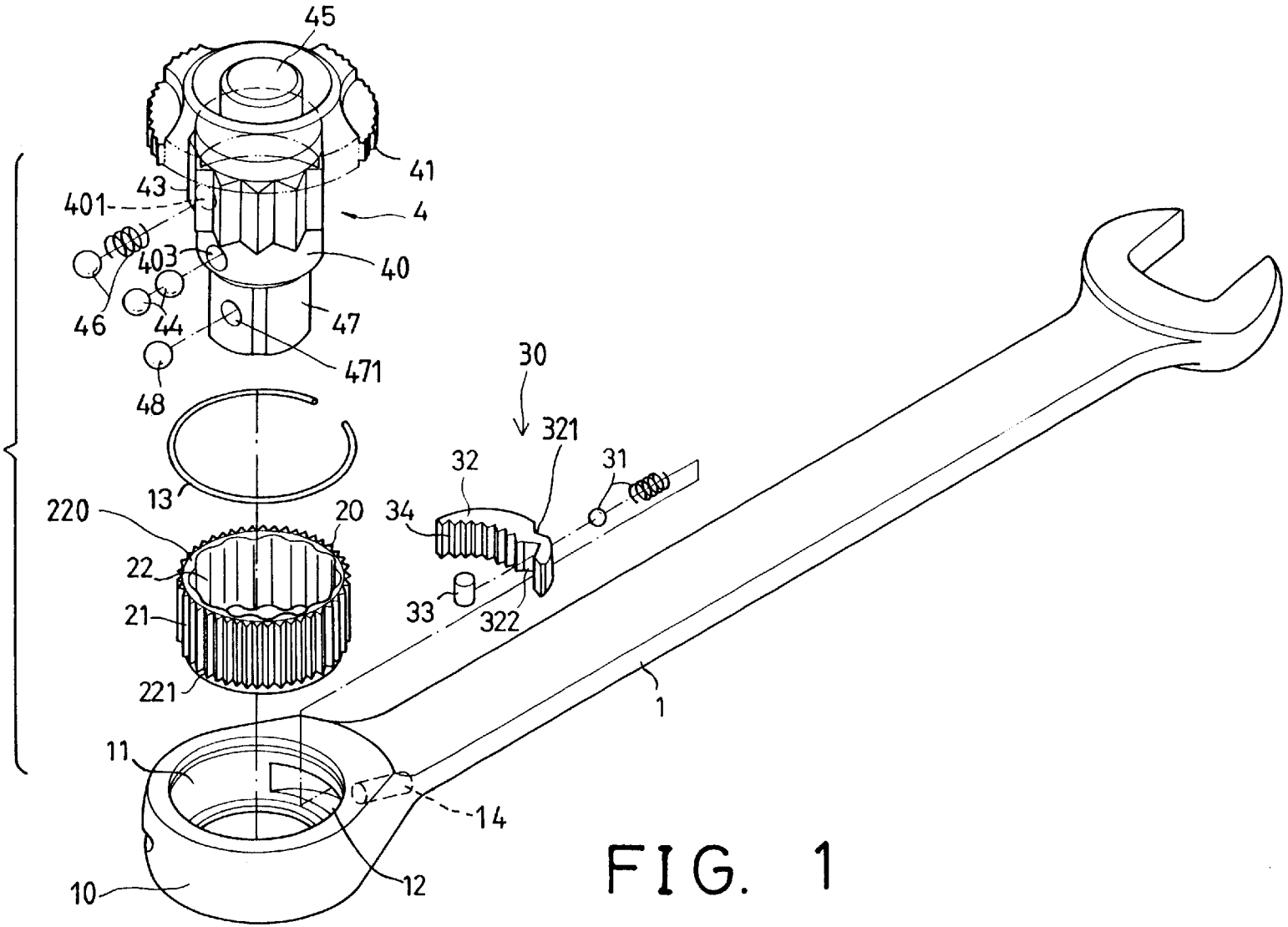
FIG. 1 is a partial exploded view of a ratchet wrench in accordance with the present invention.
Figure 2:
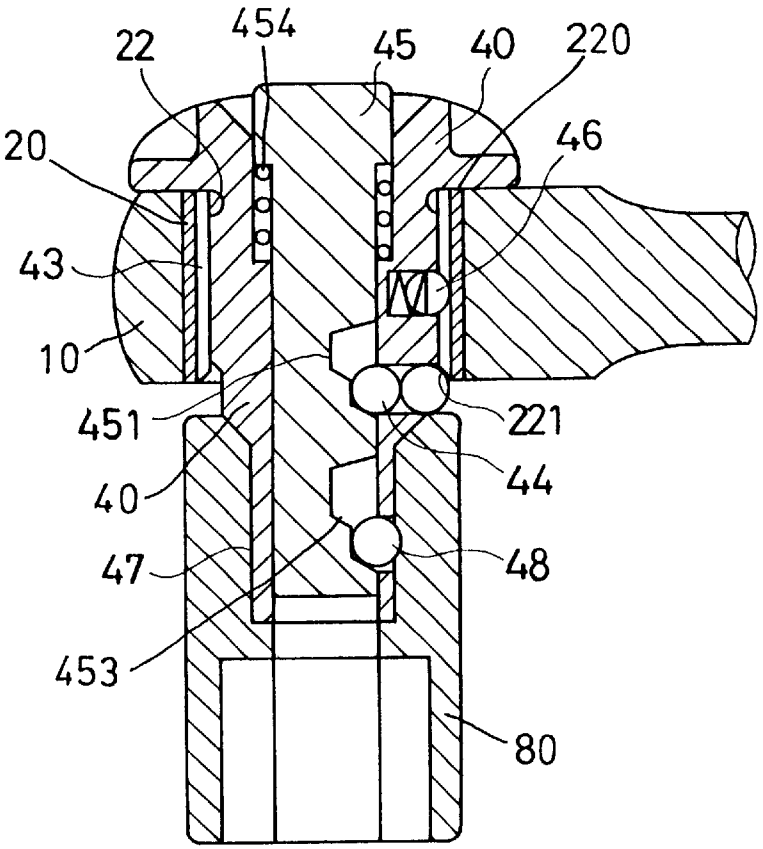
FIG. 2 is a partial cross sectional view of the ratchet wrench as shown in FIG. 1.

Referring to the drawings, and initially to FIGS. 1 and 2, a ratchet wrench in accordance with the present invention ;comprises a head 10 formed or provided on one end of a handle 1, and including a bore 11 formed therein for rotatably receiving a ratchet wheel 20, and including a chamber 12 and a cavity 14 formed in the head 10 and/or in the handle 1 for receiving a driving direction control device 30 therein. For example, the driving direction control device 30 includes a pawl 32 received in the chamber 12 of the head 10, and a spring-biased projection 31 received in the cavity 14 of the handle 1 and engaged with the pawl 32 for controlling the engagement of the pawl 32 with the ratchet wheel 20.

The ratchet wheel 20 includes an outer peripheral portion having a number of ratchet teeth 21 formed or provided thereon, for engaging with the pawl 32, and includes an engaging hole 22, particularly a non-circular engaging hole 22 formed therein for receiving the other tool members, or the tool extensions, or the other fasteners, and includes an upper peripheral portion 220, and a lower and inner peripheral portion 221. A retaining ring 13 may further be provided and engaged between the upper peripheral portion 220 of the ratchet wheel 20 and the head 10 for retaining the upper portion of the ratchet wheel 20 to the head 10.

The pawl 32 includes an outer portion having a notch 321 formed therein for receiving the spring-biased projection 31, and includes an inner portion having a number of teeth 34 formed thereon, such as formed in the two ends thereof for selectively engaging with the teeth 21 of the ratchet wheel 20. The inner portion of the pawl 32 further includes a depression 322 formed therein for receiving a rod 33 which may be secured or force-fitted in the chamber 12 of the head 10, for allowing the pawl 32 to be rotated relative to the head 10 about the rod 33, and for allowing the teeth 34 at either of the ends of the pawl 32 to be selectively rotated or moved to engage with the teeth 21 of the ratchet wheel 20, in order to control the driving direction of the ratchet wheel 20 by the handle 1 and the head 10.

A socket adapter 4 includes a shell 40 to be received in the engaging hole 22 of the ratchet wheel 20 and having a non-circular engaging surface 43 formed or provided on the outer peripheral portion thereof for engaging with the non-circular engaging hole 22 of the ratchet wheel 20 and for allowing the shell 40 of the socket adapter 4 to be rotated in concert with the ratchet wheel 20 and to be rotated or driven by the head 10 of the handle 1. The shell 40 includes an enlarged knob 41 provided on top thereof and extended radially outward therefrom for engaging onto the ratchet wheel 20 and onto the upper portion of the head 10, best shown in FIG. 2.

The shell 40 includes a hole 401 formed therein for receiving a spring-biased projection 46 which may engage with the inner peripheral portion of the ratchet wheel 20 (FIG. 2) for positioning the shell 40 to the ratchet wheel 20 at the required angular position. The shell 40 further includes an orifice 403 formed therein for receiving one or more balls 44 or for receiving an elongate latch (not shown) therein, and for engaging with the lower and inner peripheral portion 221 of the ratchet wheel 20 (FIG. 2). The shell 40 includes a shank 47 extended downward therefrom for engaging into such as a socket 80, and having an aperture 471 formed therein for receiving a ball 48 which may be forced to engage with the socket 80 and to secure the socket 80 to the shank 47.

A shaft 45 is slidably engaged in the shell 40 and the shank 45, and includes a recess and/or an actuator 451 for engaging with the balls 221 and for forcing the balls 221 to engage with the lower and inner peripheral portion 221 of the ratchet wheel 20 and to secure and retain the ratchet wheel 20 to the shell 40. The shaft 45 further includes la recess and/or an actuator 453 for engaging with the ball 48 and for forcing the ball 48 to engage with the socket 80 and to secure and retain the socket 80 to the shank 47. A spring 454 may be engaged between the shaft 45 and the shell 40 for biasing the shaft 45 to move relative to the shell 40 and for biasing the actuators 451, 453 to engage with the balls 221, 48.

It is to be noted that the shaft 45 may simultaneously bias or force the actuators 451, 453 to engage with the balls 221, 48, in order to secure the ratchet wheel to the shell 40, and in order to secure the socket 80 to the shank 47 simultaneously. A single ball 221 or a single latch may also be used to engage with the lower and inner peripheral portion 221 of the ratchet wheel 20 and to secure and retain the ratchet wheel 20 to the shell 40, instead of the two balls 221 when the shell 40 includes a thinner wall.

It is further to be noted that, without the retaining ring 13, the upper peripheral portion 220 of the ratchet wheel 20 may also be engaged with the enlarged knob 41 of the shell 40 and may thus be retained to the head 10 by the enlarged knob 41 of the shell 40.

Figure 4:
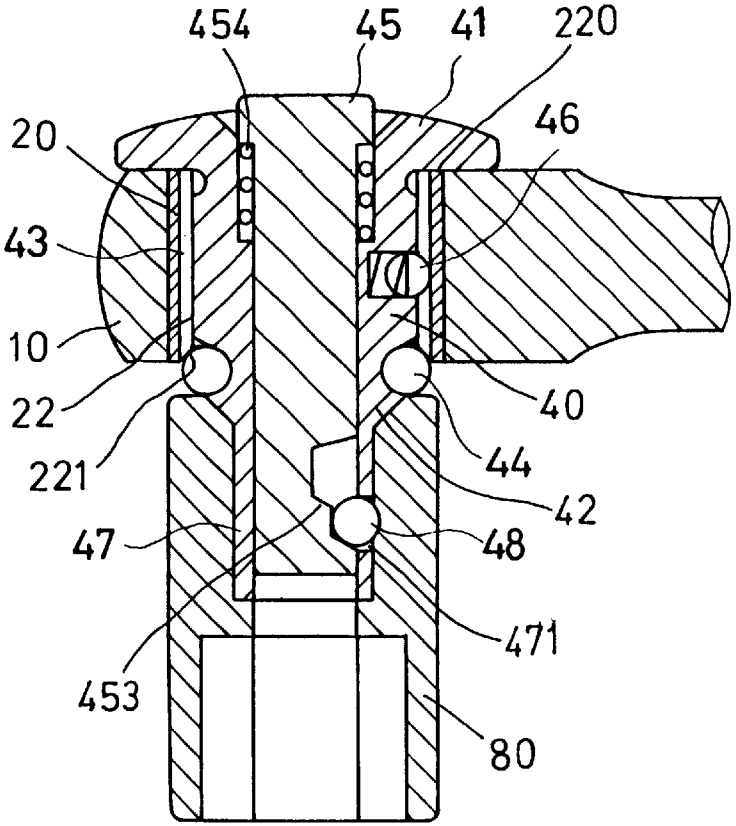
FIG. 4 is a partial cross sectional view of the ratchet wrench as shown in FIG. 3.
Figure 3:
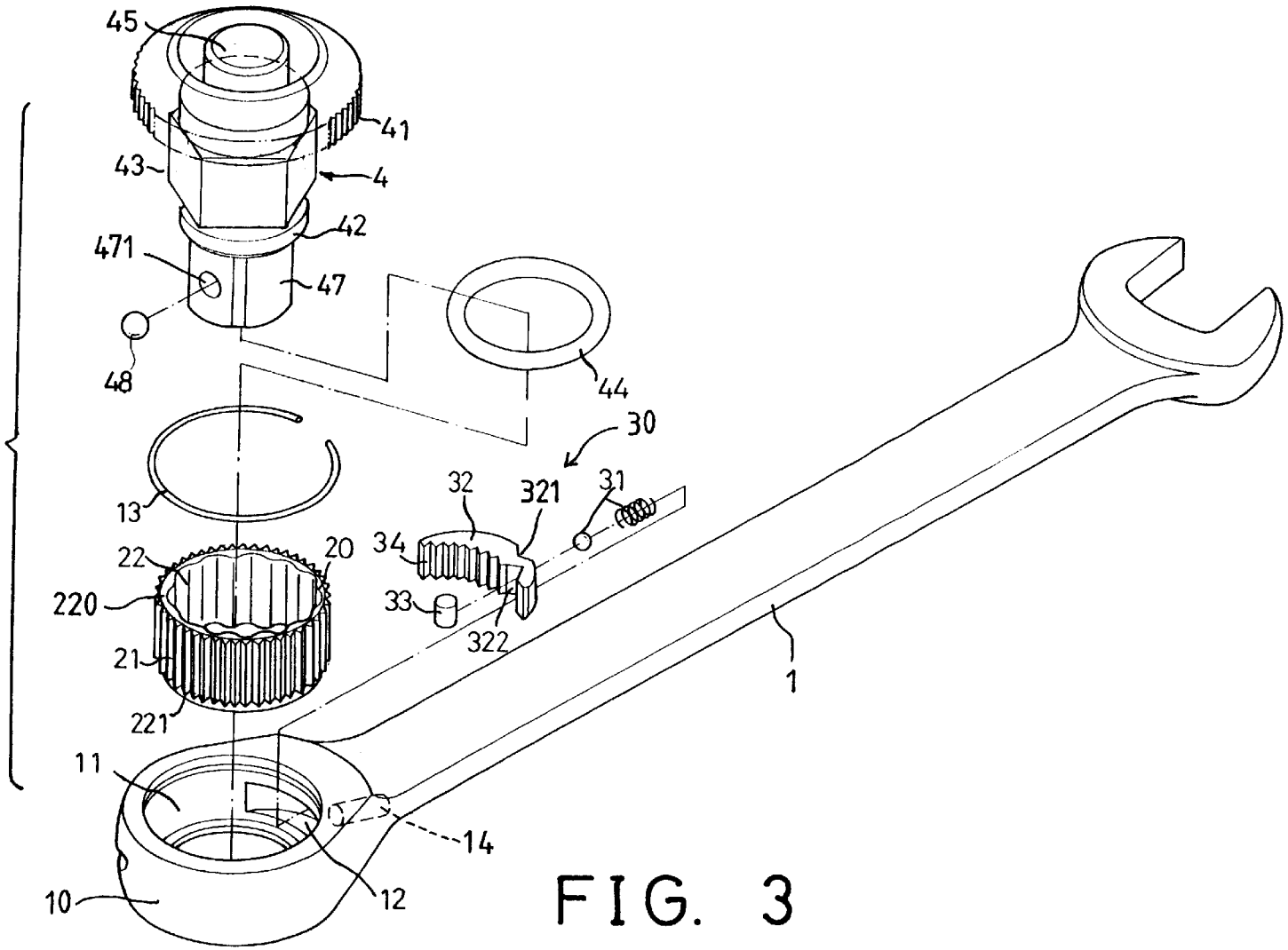
FIG. 3 is a partial exploded view illustrating the other embodiment of the ratchet wrench.

Alternatively, as shown in FIGS. 3 and 4, the socket adapter 4 may include a circular plate 42 extended therefrom for engaging with a sealing ring 44 or a retaining ring or the like, and for engaging with and/or forcing the sealing ring 44 to engage with the lower and inner peripheral portion 221 of the ratchet wheel 20 and to secure and retain the ratchet wheel 20 to the shell 40, instead of the ball(s) 221. The sealing ring 44 is engaged with the smooth lower and inner peripheral portion 221 of the ratchet wheel 20 and will not be engaged with the teeth of the ratchet wheel 20 such that the sealing ring 44 will not be damaged by the ratchet wheel 20.

The typical socket adapters comprise a shaft for engaging with and for forcing one or more balls to engage with the socket and to secure and retain the socket to the driving shank or to the adapter. The typical socket adapters do not teach to provide the other ball or sealing ring to engage with the ratchet wheel and to secure and retain the ratchet wheel to the socket adapter simultaneously.

Accordingly, the ratchet wrench in accordance with the present invention includes a securing device for solidly securing or retaining the socket adapter and/or the ratchet wheel to the handle of the ratchet wrench.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet wrench comprising:

a handle including a head having a borer formed therein, a ratchet wheel rotatably received in said bore of said head, said ratchet wheel including an outer peripheral portion having a plurality of teeth formed thereon, and including an engaging hole formed therein, and including an upper portion, and including a lower and inner peripheral portion, means for controlling a driving direction of said ratchet wheel by said head of said handle, a socket adapter including a shell engaged in said engaging hole of said ratchet wheel, and a shank extended from said shell for engaging with a tool member, a first ball engaged in said shell, a second ball engaged in said shank, and a shaft slidably engaged in said shell and said shank for selectively actuating said first ball to engage with said lower and inner peripheral portion of said ratchet wheel and to secure said ratchet wheel to said socket adapter, and for selectively actuating said second ball to engage with the tool member and to secure the tool member to said shank.

2. The ratchet wrench according to claim 1 further comprising a third ball engaged in said shell and engaged with said first ball, for allowing said first ball and said third ball to be actuated to engage with said lower and inner peripheral portion of said ratchet wheel.

3. The ratchet wrench according to claim 1, wherein said head of said handle includes an upper portion, said shell includes an enlarged knob provided on top thereof and engaged with said upper portion of said ratchet wheel and engaged with said upper portion of said head.

4. The ratchet wrench according to claim 1 further comprising means for retaining said upper portion of said ratchet wheel to said head.

5. The ratchet wrench according to claim 1, wherein said engaging hole-of said ratchet wheel is a non-circular engaging hole, said shell includes an outer peripheral portion having a non-circular engaging surface for engaging with said non-circular engaging hole of said ratchet wheel and for allowing said shell to be rotated in concert with said ratchet wheel.

6. The ratchet wrench according to claim 1 further comprising a spring-biased projection engaged in said shell for engaging with said ratchet wheel and for positioning said ratchet wheel to said shell.

7. The ratchet wrench according to claim 1 further comprising means for bias said shaft to actuate said first and said second balls.

* * * * *